US011260266B2

(12) United States Patent
Pena

(10) Patent No.: US 11,260,266 B2
(45) Date of Patent: Mar. 1, 2022

(54) LEG EXERCISER ADAPTABLE TO AN OFFICE CHAIR

(71) Applicant: Donrobert Pena, City of Industry, CA (US)

(72) Inventor: Donrobert Pena, City of Industry, CA (US)

(73) Assignee: Paradigm Health and Wellness, City of Industry, CA (US)

( * ) Notice: Subject to any disclaimer, the term of this patent is extended or adjusted under 35 U.S.C. 154(b) by 40 days.

(21) Appl. No.: 16/817,025

(22) Filed: Mar. 12, 2020

(65) Prior Publication Data

US 2020/0289882 A1 Sep. 17, 2020

Related U.S. Application Data

(60) Provisional application No. 62/818,886, filed on Mar. 15, 2019.

(51) Int. Cl.
*A63B 22/06* (2006.01)

(52) U.S. Cl.
CPC ..... *A63B 22/0694* (2013.01); *A63B 22/0605* (2013.01); *A63B 2022/0635* (2013.01)

(58) Field of Classification Search
CPC ..... A63B 22/0694; A63B 22/0605; A63B 2022/0635; A63B 2210/02; A63B 2225/09; A63B 2225/66; A63B 2208/0233; A63B 2225/74; A63B 71/0036; A63B 71/0622; A63B 21/1609
See application file for complete search history.

(56) References Cited

U.S. PATENT DOCUMENTS

| | | | | |
|---|---|---|---|---|
| 4,222,376 | A | 9/1980 | Praprotnik | |
| 4,262,902 | A | 4/1981 | Dranselka | |
| 4,390,177 | A | 6/1983 | Biran et al. | |
| 5,490,824 | A | 2/1996 | Wang | |
| 3,259,385 | A | 7/1996 | Boren | |
| 7,648,447 | B2 | 1/2010 | Andre | |
| 8,920,292 | B1 * | 12/2014 | Myers | A63B 22/0605 482/57 |
| 9,278,251 | B2 * | 3/2016 | Decca | A63B 22/0694 |
| 2006/0276311 | A1 * | 12/2006 | Martin | A63B 21/0552 482/92 |
| 2017/0216660 | A1 * | 8/2017 | Lernihan | A63B 22/0664 |

* cited by examiner

*Primary Examiner* — Andrew S Lo
*Assistant Examiner* — Andrew M Kobylarz
(74) *Attorney, Agent, or Firm* — Kirk A. Buhler; Buhler & Associates Patenting

(57) ABSTRACT

Improvements in an exercise cycle is disclosed. The cycle is adaptable to an office chair with a hook feature that allows for easy engaging and disengaging of an office chair floor leg, support or caster. The extending hook allows for users of different heights to make use of the chair hook without requiring a user to change hooks to accommodate different heights of a user and office chair casters. The pedals are connected through a common axis and connect to a loading mechanism. There can be a flywheel and a transmission that alters the turning rate of the flywheel and/or the loading mechanism. The size and shape of the resistance loading housing is configured to fit under a common office desk. The user's weight, is transferred to the plate through the office chair caster to improve the stability of the desk bike.

20 Claims, 4 Drawing Sheets

LEG EXERCISER ADAPTABLE TO AN OFFICE CHAIR

CROSS REFERENCE TO RELATED APPLICATIONS

This application claims the benefit of Provisional Application Ser. No. 62/818,886 filed Mar. 15, 2019 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a leg exerciser. More particularly, the present leg exerciser is adaptable to an office chair. This allows a user to move one of the wheels of their office chair onto a platform of the exercise cycle to exercise.

Description of Related Art Including Information Disclosed Under 37 CFR 1.97 and 1.98

Many people have a desire to exercise, but find it difficult to find the time to exercise due to work at a desk or other location. Most office workers spend the majority of their day sitting in a chair behind a desk. While they user their arms to type, write, read or move documents their legs remain stationary for the majority of the day. Most exercise cycles include a seat, and a display that extends from the cycle to elevated handlebars. This limits the ability of a person to place the cycle completely under a desk so they can exercise while they work.

A number of patents and or publications have been made to address these issues. Exemplary examples of patents and or publication that try to address this/these problem(s) are identified and discussed below.

U.S. Pat. No. 4,262,902 issued on Apr. 21, 1981 to Marvin A. Dranselka and is titled Portable Exercise Device. This patent discloses a portable pedaling type exercise device which is attachable to a conventional chair without alteration includes a rear member which is held rigidly between a pair of opposing legs of a chair by the application of compressive force. Flexibility in the location of the pedal assembly in relation to the chair and floor is achieved through adjustable length members of the supporting frame. A direct mechanism for applying selective drag to the pedal shaft and removable stirrups for securing feet to the pedals are also provided.

U.S. Pat. No. 4,390,177 issued on Jun. 28, 1983 to Benjamin Biran et al., and is titled Foot-Operated Exercising Device. This patent discloses a foot-operated exercising device comprises a frame having a longitudinally-extending frame bar terminating at its opposite ends in a pair of transversely-extending frame legs for supporting the frame bar on a horizontal surface, and a pair of foot pedals rotatably mounted on the frame bar about a horizontal, transversely-extending axis. The device further includes a pair of variable-length arms pivotably mounted to one of the frame legs about vertical axes to permit pivoting the arms to an operable position extending at a desired angular relationship axially behind the frame legs, or to a non-operable position in folded relationship with respect to the frame legs.

U.S. Pat. No. 5,490,824 issued on Feb. 13, 1996 to Chih C. Wang and is titled Limb Exerciser. This patent discloses a limb exerciser mainly including an outer wheel housing and an inner wheel set in the outer wheel housing. With frictional members disposed between the contact surfaces of the outer wheel housing and the inner wheel, as well as actuating members oppositely disposed at two sides of the inner wheel, the inner wheel can be rotated relative to the outer wheel housing by pushing or pedaling the actuating members to produce frictional force or resistance and thereby helps the user to conveniently take hand or foot exercise at a desk top or on a floor or ground.

U.S. Pat. No. 7,648,447 issued on Jan. 19, 2010 to Christian Saint Andre and is titled Leg Exerciser for use with an Office Chair. This patent discloses a leg exercise device for use with an office chair including a back, a seat, and a seat support. The leg exercise device includes a leg exercise mechanism for use by a user while seated on the office chair to exercise the user's legs, and a rigid connection mechanism extending from the leg exercise mechanism for detachably and rigidly connecting the leg exercise mechanism to the seat support of the office chair.

What is needed is an exercising cycle that is easily configured to operate with a desk chair. The proposed cycle that is adaptable to an office chair to provide a solution to allow a person to exercise while seated in an office chair.

BRIEF SUMMARY OF THE INVENTION

It is an object of the leg exerciser that is adaptable to an office chair to have a hook feature that allows for easy engaging and disengaging of an office chair floor support or caster. The extending hook allows different heights users adjust the length of the hook to accommodate their height and body geometry to connect the leg exerciser to office chair casters. The distance between the hook and the pedals is adjustable. The hook can also be removed to eliminate the obstruction of the hook and the supporting plate. The hook can also be used to lift the mainframe housing to allow a user to wheel the leg exerciser on wheels that are integrated into the mainframe housing.

It is an object of the leg exerciser that is adaptable to an office chair to have an adjustment that allows a user to alter the hook distance between the hook and the loading mechanism that includes pedals for a user to cycle for exercise. The pedals are connected through a common axis and connect to a loading mechanism. There can be a flywheel and a transmission that alters the turning rate of the flywheel and/or the loading mechanism.

It is another object of the leg exerciser that is adaptable to an office chair to have an adjustable loading mechanism. The adjustable loading mechanism can take a variety of configuration and can provide a constant amount of resistance or can follow a program that changes while the person is exercising. The size and shape of the mainframe resistance loading housing is configured to fit under a common office desk.

It is still another object of the leg exerciser to make the leg exerciser adaptable to connect and secure to an office chair. A hook that holds the office chair caster is welded to a flat plate and the hook is curved to capture and center the caster wheel to prevent the caster from moving left or right. The flat plate provides a surface that the office chair caster rests upon. A portion of the user's weight is transferred to the plate through the office chair caster to improve the stability of the desk bike. This stability is needed due to the high resistance level. The user's weight aids in holding the bike in place. Without the coupling of the user's weight to the leg exerciser, the leg exerciser can move away at some high resistance levels. The added weight of the user prevents the resistance housing from fishing tailing or shifting during use.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
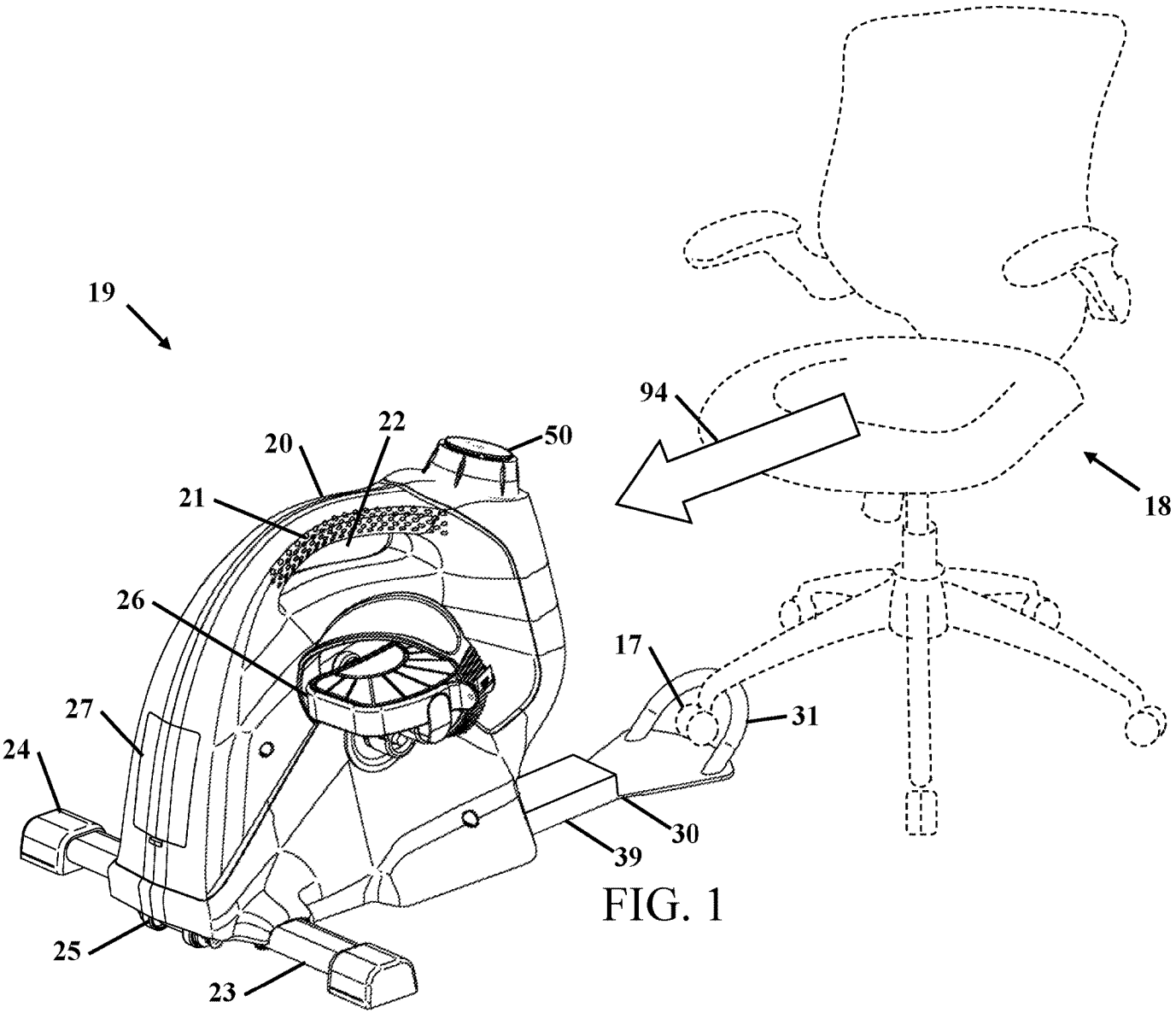
FIG. 1 shows a perspective view of the office chair cycle in an environment of use.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

| Item Numbers and Description | |
|---|---|
| 17 wheel/caster | 18 chair |
| 19 office chair cycle | 20 housing |
| 21 textured holes | 22 open handle |
| 23 horizontal leg | 24 foot |
| 25 wheel(s) | 26 pedal |
| 27 battery door | 28 frame |
| 30 support plate | 31 hook |
| 32 back plate | 33 control arm |
| 34 spring | 35 slide tube |
| 36 slots | 37 locking tab |
| 38 pivot | 39 tubular structure |
| 40 guide tube | 41 set screw |

-continued

| Item Numbers and Description | |
|---|---|
| 50 resistance control knob | 51 axle |
| 52 tension/align screws | 53 flywheel |
| 54 first pulley | 55 second pulley |
| 56 belt | 57 support frame |
| 58 LED | 59 friction rotation axis |
| 60 slot | 93 angle |
| 94 pushes | 95 pushes |
| 96 slide | 97 adjustment range |
| 98 lift | 99 rotate |

FIG. 1 shows a perspective view of the office chair 18 and cycle 19 in an environment of use. In this figure, an office chair 18 is shown in broken line with a chair 18 floor support or caster 17 shown engaged in the hook 31. The hook 31 prevents the office chair 18 from moving away from the cycle 19 and the hook 31 is shaped to prevent side-to-side motion of the caster 17. When properly engaged, the hook 31 retains three directions of motion of the caster 17. The caster 17 sits on top of a support plate 30 to add additional forces to hold the cycle 19 down. The purpose of hook 31 feature is to allow easy engaging and disengaging from an office cycle 19 caster 17. The extending hook 31 allows for users of different heights to make use of the chair hook 31 and the support plate 30 that can be extended from the housing 20 to accommodate different height users.

The hook 31 that holds the office chair caster 17 is attached to the flat plate 30. The hook 31 is preferably formed from a round or a rectangular tube. The flat plate 30 adds a small amount of elevation to the caster 17 and when the office chair 18 and leg exerciser 19 is used on a carpeted or padded surface the remaining casters and support arms to the chair 18 cushion the elevated difference caused by the flat plate 30. The user's weight is transferred to the plate 30 through the office chair caster 17 to improve the stability of the under-desk bike. This stability is needed when the bike is used at high resistance level when pedaling. If the user's weight is not aiding in holding the bike in place, either the user or the bike would move while in use, due to the high resistance exercise level. The added weight of the user on the chair that is transferred through the caster 17 and then onto the support plate 30 prevents the cycle unit from fishing tailing or shifting during use. As the user pushes 94 against the pedals 26 the caster 17 is forced into the hook 31 to maintain the distance between the chair 18 and the pedals 26. The plate 30 is connected to a tubular structure 39 that can be moved and locked into the housing 20.

The housing 20 encloses the internal loading or resistance mechanism that places rotational resistance onto the pedals 26 that are located on opposing sides of the housing 20. The housing has an open handle 22 whereby a user can grasp the handle 22 to carry the office chair cycle 19. The housing 20 can have a series of textured holes 21 for cooling or can be textured to improve a grip thereby making the office chair cycle 19 easier to lift and carry. The office chair cycle 19 can also be transported by lifting the hook 31 and wheeling the office chair cycle 19 on the wheels 25 that are located on the opposite side of the hook 31. At the sides of the wheels is/are a horizontal leg 23 that terminate with feet 24. The horizontal leg 23 and feet 24 provide a broad base to improve stability of the office chair cycle 19, especially when the office chair cycle 19 is being used at higher levels of intensity. The rear of the office chair cycle 19 has an access door 27 for batteries that power a console for the office chair cycle 19. A user can control the intensity of the workout by turning or adjusting a control knob 50 that is placed in proximity to the top front of the office chair cycle 19 to allow a user to easily adjust the resistance while they are exercising.

While a supporting plate 30 is shown and described, it is contemplated that the supporting plate 30 can be optional or removed and the hook 31 simply extends from the tubular structure 39 out and around about three sides of the office chair 19 caster or a simple office chair leg or floor support.

Figure 2:
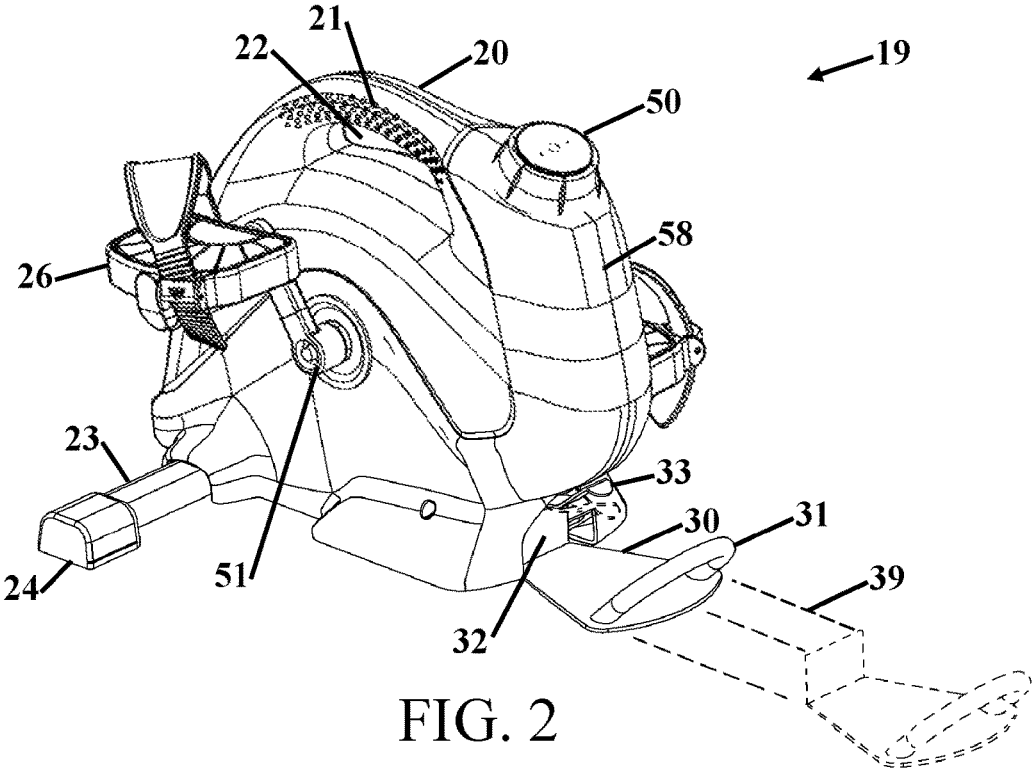
FIG. 2 shows a perspective view of the office chair cycle.

FIG. 2 shows a perspective view of the office chair cycle 19. In the front perspective view the hook 31 and supporting plate 30 is shown in retracted condition and in broken lines in an extended orientation. The hook 31 and the supporting plate 30 are extended by depressing a control arm 33 down. This releases a tab in the tube of the back plate 32. The hook 31 can then be withdrawn to extend the distance from the hook 31 to the pedals 26 to enable users of different heights to comfortably use the office chair cycle 19. The back plate 32 provides a surface to prevent a caster from being pushed into the housing 20.

From this perspective view the open handle 22 is visible with the textured holes 21 on the upper portion of the handle. The rear of the housing shows the horizontal leg 23 with foot 24 located on the outside of the horizontal leg 23.

The pedals 26 are connected to a cycle axle 51 that passes through the housing where it links to a pedal on the opposing side of the housing 20. The two pedals are linked at 180 degrees opposed orientation, as is typically found in most cycle machines. The resistance control knob 50 is shown and a Light Emitting Diode or LED 58 illuminates when the office chair cycle 19 is active to notify a user that some battery power is being used.

Figure 3:
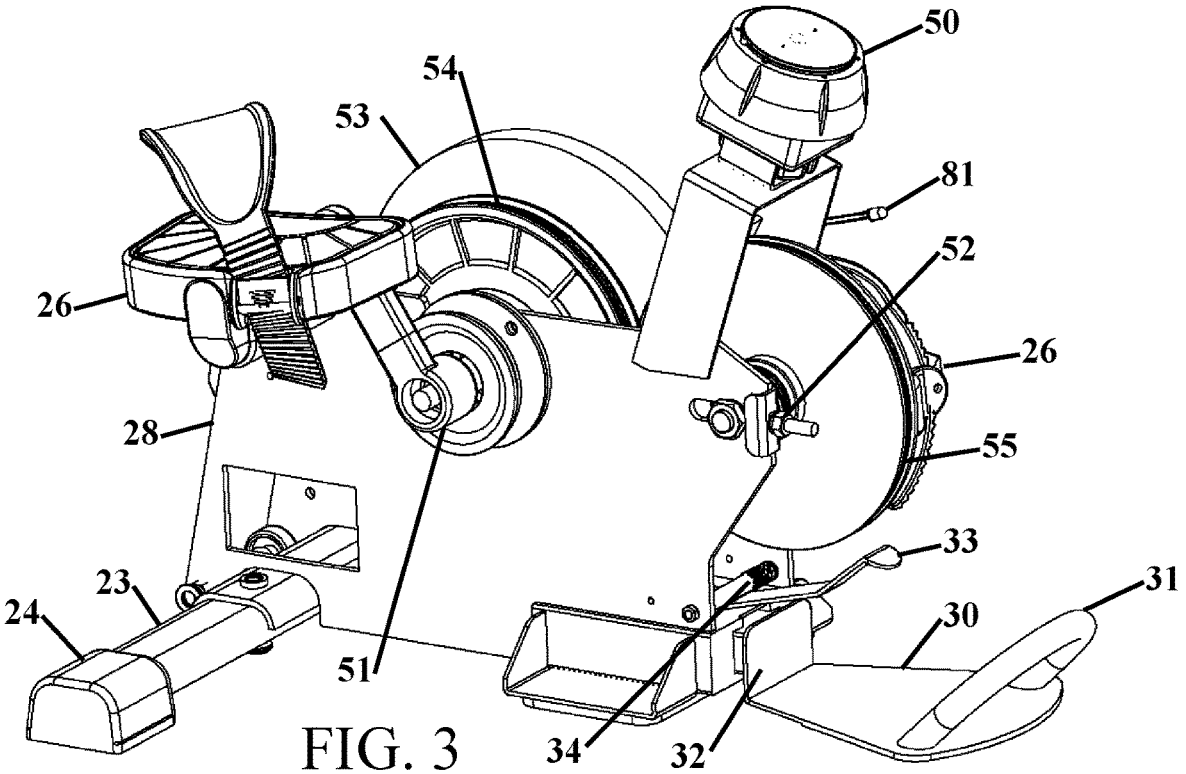
FIG. 3 shows a perspective view of the office chair cycle without the outer housing.

FIG. 3 shows a perspective view of the office chair cycle without the outer housing. With the outer housing removed the pedal 26 on the left side of the machine is visible and a portion of the pedal 26 on the right side of the machine. The pedals 26 are connected through the axis 51 through a frame 28. The axis 51 has a drive belt pulley 54 and a flywheel 53 that provides a rotational mass to provide a smoother rotation to simulate an action of a bicycle on a road. The frame 28 is secured to the horizontal leg 23 and then supported on foot 24.

A belt connects the drive belt pulley 54 to a loading wheel 55. The loading wheel 55 provides the resistance to turning the pedals 26. The loading pulley 55 is supported on the frame 28 with a pair of tension and alignment bolt or screws 52 that both allow for setting the tension of the connecting belt and for truing the track of the belt. The resistance control knob 50 is shown above the loading wheel 55 and the indicator LED 58 is located where it will be visible through the housing.

The support plate 30 is shown with the hook 31 and back plate 32. With the housing removed the control arm 33 is visible and the control arm 33 is shown secured to a pivoting axis where a spring 34 biases the control arm 33 into the top of the tube that is connected to the back plate 32.

Figure 4:
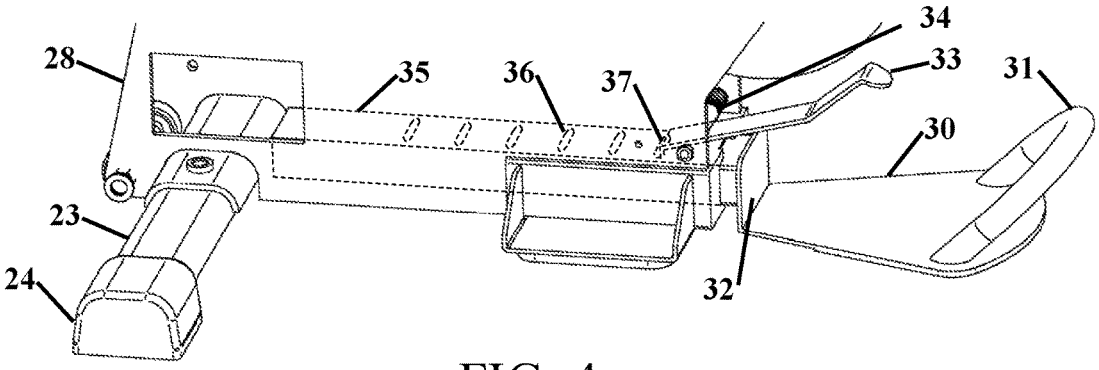
FIG. 4 shows the adjustable caster capture hook.
Figure 5:
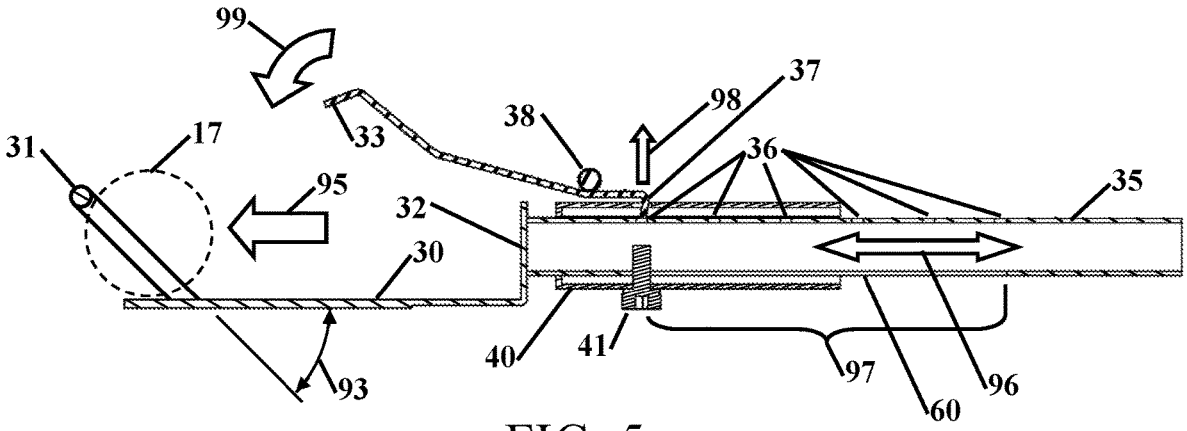
FIG. 5 shows a sectional view of the adjustable caster capture hook.

FIG. 4 shows the adjustable caster capture hook 31 and FIG. 5 shows a sectional view of the adjustable caster 17 and capture hook 31. These figures mainly show the adjustment, capture and indexing mechanism used with the caster wheel 17. The frame 28 is supported on the horizontal tube 23 on foot 24. As previously described the caster 17 sits on the support plate 30 in front of the back plate 32 to increase the apparent weight of the machine. As the user pushes against the pedals the resulting force pushes 95 the caster into the hook 31. The hook 31 is a tubular member and is oriented at an angle 93 to capture the push 95 and also create side-to-side stability to maintain the position of the caster 17 when a user is cycling. While a particular angle is shown, the support plate 30 and hook 31 will catch the force 95 which keep the caster 17 and hook 31 engaged. The support plate 30 needs to be low enough to not obstruct an office chair from rolling over the hook 31, but still high enough to prevent the caster 17 from rolling over or climbing over the hook 31 when the force 95 is large when the control knob 50 is set to a high resistance level. The inside height of the hook is configured to capture the caster from under the supporting leg of the office chair 18. When a user is no longer maintaining cycling pressure, a user can simply roll the caster 17 off of the support plate 30 without requiring the user to lift the chair or caster onto or off of the machine. The support plate 30 provides a similar height above the carpet or underlying surface as a chair carpet protector.

From these views the back plate 32 is secured to a slide tube 35. The slide tube 35 has a plurality of rectangular openings 36 on the top surface. A control arm 33 passes through a pivot 38. On the opposing side of the pivot 38 the control arm has a locking tab 37 that engages into one of the rectangular openings 36. The pivot 38 is biased with a spring 34 to maintain the locking tab 37 in a rectangular opening 36 or encourages the locking tab 37 to drop into a rectangular opening 36 when a rectangular opening opens under the locking tab 37. To dis-engage the locking tab 37 from a rectangular opening 36 a user simply pushed down 99 on the end of the control arm 33 to lift 98 the locking tab 37 where the slide tube 35 can freely slide within the guide tube 40.

The control arm 33 is positioned to be activated by depressing the control arm 33 to allow the slide tube 35 to freely move. The user can depress the control arm 33 and pushes or pulls 96 either the hook 31 or support plate 30. The user can then move the support plate 30 and the locking tab 37 will be forced into the next rectangular hole that is presented. The adjustment range travel 97 of the slide tube 35 is controlled by set screw 41 located a slot 60 in the bottom of the slide tube 35. Removal of the set screw 41 allows the slide tube 35, supporting plate 30 and hook 31 to be completely removed from the guide tube 40 and the housing.

Figure 6:
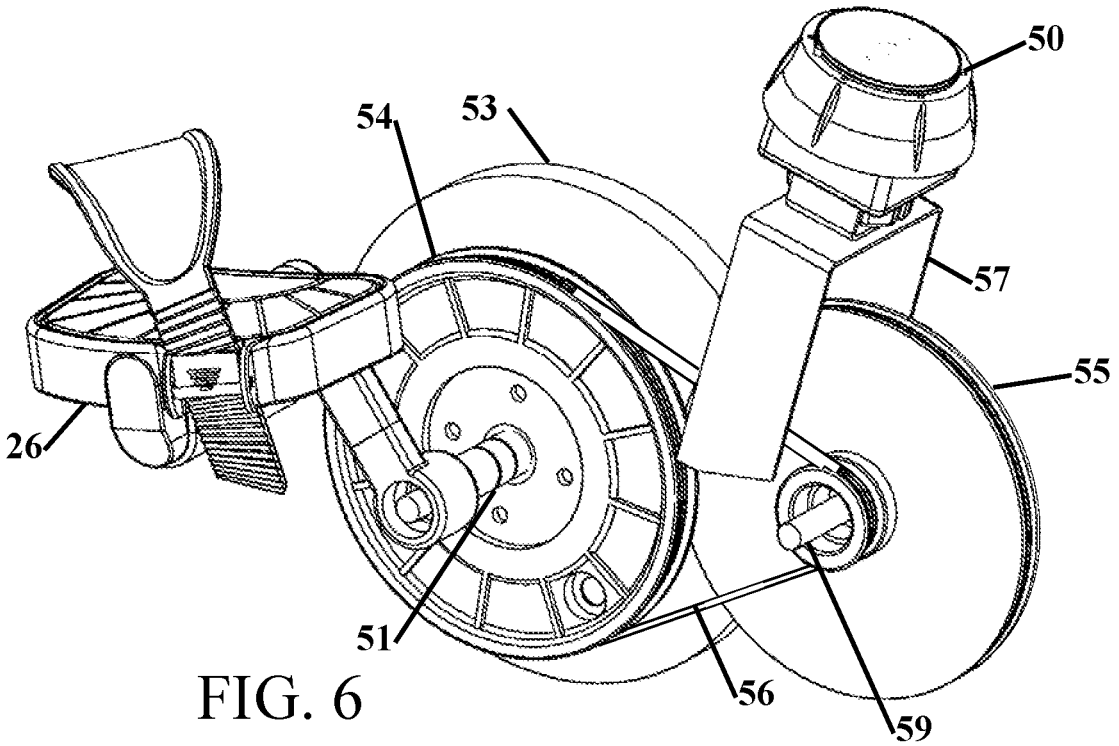
FIG. 6 shows a perspective view of the resistance loading system.
Figure 7:
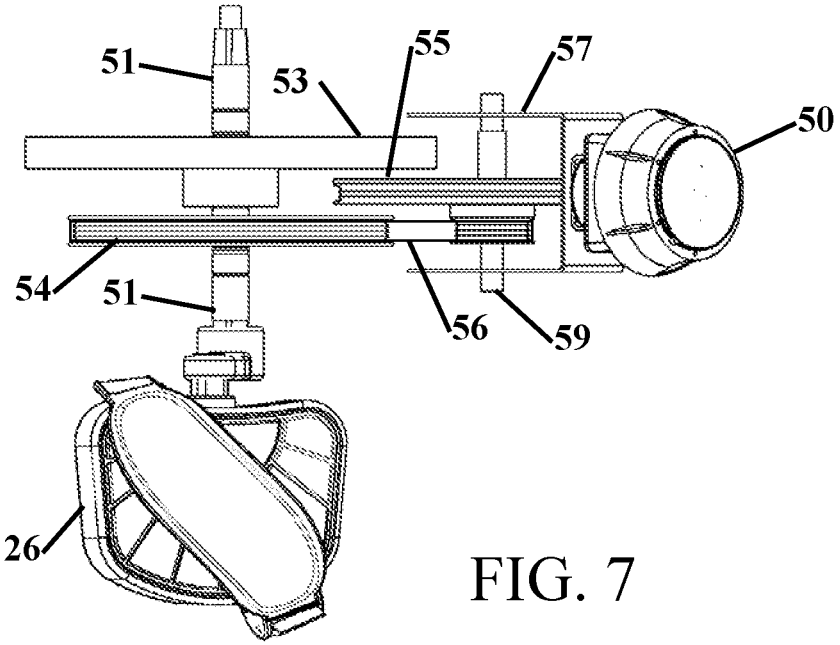
FIG. 7 shows a top view of the resistance loading system.

FIG. 6 shows a perspective view of the resistance loading system and FIG. 7 shows a top view of the resistance loading system. The pedals 26 are connected through the cycle axle 51 through a frame 28. The cycle axle 51 has a drive belt 56 that runs on a drive belt pulley 54 and a flywheel 53 that provides a rotational inertial that provides a smoother rotation to compensate for the pealing motion.

A belt connects the first pulley 54 to a second pulley 55 that multiples the rotation of the cranks a second time after the first pulley 54. This arrangement creates a dual transmission. The end result is that the flywheel rotates faster than it would if there was just one pulley connected to the flywheel. The second pulley 55 is supported through a friction rotation axis 59 on the frame with a bolts or other threaded fasteners (not shown in this figure) that both tension and align. The resistance control knob 50 is shown above the second wheel 55 mounted on a support frame 57 that maintains the position of the control knob 50 at an opening in the outer housing.

Thus, specific embodiments of a cycle that is adaptable to an office chair have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A leg exerciser that is adaptable to an office chair comprising:

a resistance leg exerciser machine;

said resistance leg exerciser machine having a hook on an extendable support plate structure;

said hook extending from said support plate;

said hook is secured to said floor support plate and rises in an arc up and over said support plate at an angle that is configured to capture a caster of a chair within said hook;

said hook being configured to capture said caster of the office chair within essentially three sides of said hook while said caster is on said support plate, and said hook is open on a fourth side whereby said caster can freely move or roll off said support plate and out of said hook without requiring said caster of the office chair to be lifted over said hook.

2. The leg exerciser that is adaptable to the office chair according to claim 1, wherein said hook allows engaging and disengaging of a caster said floor support of said chair.

3. The leg exerciser that is adaptable to the office chair according to claim 2, wherein said hook allows for users of different heights to make use of said hook.

4. The leg exerciser that is adaptable to the office chair according to claim 3, further includes a control arm that locks into said extendable structure to adjust a distance between said hook and said resistance leg exerciser machine.

5. The leg exerciser that is adaptable to the office chair according to claim 1, wherein said extendable structure is removable from said resistance leg exerciser.

6. The leg exerciser that is adaptable to the office chair according to claim 5, wherein said extendable support plate structure is fully removeable from said resistance leg exerciser machine with removal of a set screw that prevents said extendable support plate structure from being removed from said resistance leg exerciser machine.

7. The leg exerciser that is adaptable to the office chair according to claim 1, wherein when said caster of said chair rests on said support plate a load of a user on said chair is transferred through said caster onto said support plate.

8. The leg exerciser that is adaptable to the office chair according to claim 7, wherein a portion of the load on said chair is transferred to said plate through said caster onto said support plate.

9. The leg exerciser that is adaptable to the office chair according to claim 1, further includes a variable resistance mechanism.

10. The leg exerciser that is adaptable to the office chair according to claim 9, further includes a flywheel.

11. The leg exerciser that is adaptable to the office chair according to claim 1, further includes the office chair.

12. The leg exerciser that is adaptable to the office chair according to claim 11, wherein using said leg exerciser presses the caster of said chair into said hook.

13. The leg exerciser that is adaptable to the office chair according to claim 1, wherein said leg exerciser is enclosed in an essentially vertical housing with pedals that are placed on opposing sides of said essentially vertical housing.

14. The leg exerciser that is adaptable to the office chair according to claim 13, further includes a support leg that extends on opposing sides of said essentially vertical housing.

15. The leg exerciser that is adaptable to the office chair according to claim 1, wherein said hook is usable as a handle for transportation of said leg exerciser.

16. The leg exerciser that is adaptable to the office chair according to claim 1, further includes wheels on a front of said leg exerciser.

17. The leg exerciser that is adaptable to the office chair according to claim 1, wherein said support plate further includes a back plate.

18. The leg exerciser that is adaptable to the office chair according to claim 1, wherein said leg exerciser is configured to fit under a desk.

19. The leg exerciser that is adaptable to the office chair according to claim 1, wherein said hook is formed from a round or a rectangular tube.

20. The leg exerciser that is adaptable to the office chair according to claim 1, said angle of said hook is configured at an angle to floor support wherein said caster is retained within said hook while a user is using said leg exerciser.

* * * * *